US005386477A

United States Patent [19]

Popovich et al.

[11] Patent Number: 5,386,477

[45] Date of Patent: Jan. 31, 1995

[54] ACTIVE ACOUSTIC CONTROL SYSTEM MATCHING MODEL REFERENCE

[75] Inventors: Steven R. Popovich, Stoughton; Trevor A. Laak, Madison; Mark C. Allie, Oregon, all of Wis.

[73] Assignee: Digisonix, Inc., Middleton, Wis.

[21] Appl. No.: 16,694

[22] Filed: Feb. 11, 1993

[51] Int. Cl.[6] ..... G10K 11/16

[52] U.S. Cl. ..... 381/71

[58] Field of Search ..... 381/71, 94

[56] References Cited

U.S. PATENT DOCUMENTS

| | | |
|---|---|---|
| Re. 33,937 | 5/1992 | Schubert . |
| 3,701,499 | 10/1972 | Schubert et al. . |
| 4,677,676 | 6/1987 | Eriksson . |
| 4,677,677 | 6/1987 | Eriksson . |
| 4,736,431 | 4/1988 | Allie et al. . |
| 4,815,139 | 3/1989 | Eriksson et al. . |
| 4,837,834 | 6/1989 | Allie . |
| 4,987,598 | 1/1991 | Eriksson . |
| 5,022,082 | 6/1991 | Eriksson et al. . |
| 5,033,082 | 7/1991 | Eriksson et al. . |
| 5,172,416 | 12/1992 | Allie et al. . |

OTHER PUBLICATIONS

Widrow and Stearns, Adaptive Signal Processing, 1985, pp. 294–297.

*Adaptive Control,* Astrom and Wittenmark, Lund Institute of Technology, Addison-Wesley Publishing Company, Reading, Mass., 1989, Chapter 4, pp. 105–162.

"Number Theory in Science and Communications", M. R. Schroeder, Berlin: Springer-Verlag, 1984, pp. 252–261.

"Recursive Algorithms For Active Noise Control", L. Eriksson, International Symposium on Active Control of Sound and Vibration, Tokyo, Japan, Apr. 9–11, 1991, pp. 137–146.

*Primary Examiner*—Forester W. Isen

*Attorney, Agent, or Firm*—Andrus, Sceales, Starke & Sawall

[57] ABSTRACT

An acoustic system (20) includes a model reference (22) having a selectably programmable response, and an active model (24) including in combination an acoustic path (26) and an adaptive filter (28) such that the combination of the acoustic path (26) and the adaptive filter (28) adaptively models the model reference (22) such that the combined response of the acoustic path (26) and the adaptive filter (28) provides an active model response matching the response of the model reference (22).

42 Claims, 15 Drawing Sheets

ACTIVE ACOUSTIC CONTROL SYSTEM MATCHING MODEL REFERENCE

BACKGROUND AND SUMMARY

The invention relates to active acoustic control systems.

The invention arose during continuing development efforts relating to the subject matter shown and described in U.S. Pat. Nos. 4,677,676, 4,677,677, 4,736,431, 4,815,139, 4,837,834, 4,987,598, 5,022,082, 5,033,082, 5,172,416, and allowed U.S. application Ser. Nos. 07/691,557, 07/794,115, 07/835,721, all incorporated herein by reference. These patents and applications relate to active acoustic attenuation systems. Active acoustic attenuation for sound or vibration cancellation or reduction involves injecting a canceling acoustic wave to destructively interfere with and cancel or reduce an input acoustic wave. In an active acoustic attenuation system the output acoustic wave is sensed with an error transducer such as a microphone or accelerometer which supplies an error signal to an adaptive filter model which in turn supplies a correction signal to a canceling transducer such as a loudspeaker or shaker which injects an acoustic wave to destructively interfere with and cancel or reduce the input acoustic wave.

The present invention provides an active model modeling an actual desired response characteristic, and providing a controlled acoustic path matching same. A model reference is provided having a selectably programmable response. For example, in a vibration control system providing force and/or motion isolation, a certain damping response characteristic may be desired such as over-damped, under-damped, quick response, slow stable response with no overshoot, etc. A model reference is selected or programmed to have such response. An active model is then provided, including in combination an acoustic path and an adaptive filter such that the combination of the acoustic path and the adaptive filter adaptively models the model reference such that the combined response of the acoustic path and the adaptive filter provide an active model response matching the response of the model reference. The acoustic path is a sound duct, a vibration table, a frame, cab, seats, engine or interior of a vehicle, or other complex structures or environments for sound or vibration propagation where it is desired to provide a selectably programmable response of an acoustic wave propagating along an acoustic path to provide a controlled response.

In a further embodiment, the invention additionally provides active acoustic attenuation. A controlled adaptive response to the input acoustic wave is provided, matching the response of the selectably programmable model reference, and additionally the input acoustic wave is attenuated or canceled. The noted adaptively controlled response characteristic facilitates the attenuation because of the noted matching to a known model reference.

DETAILED DESCRIPTION

Figure 1:
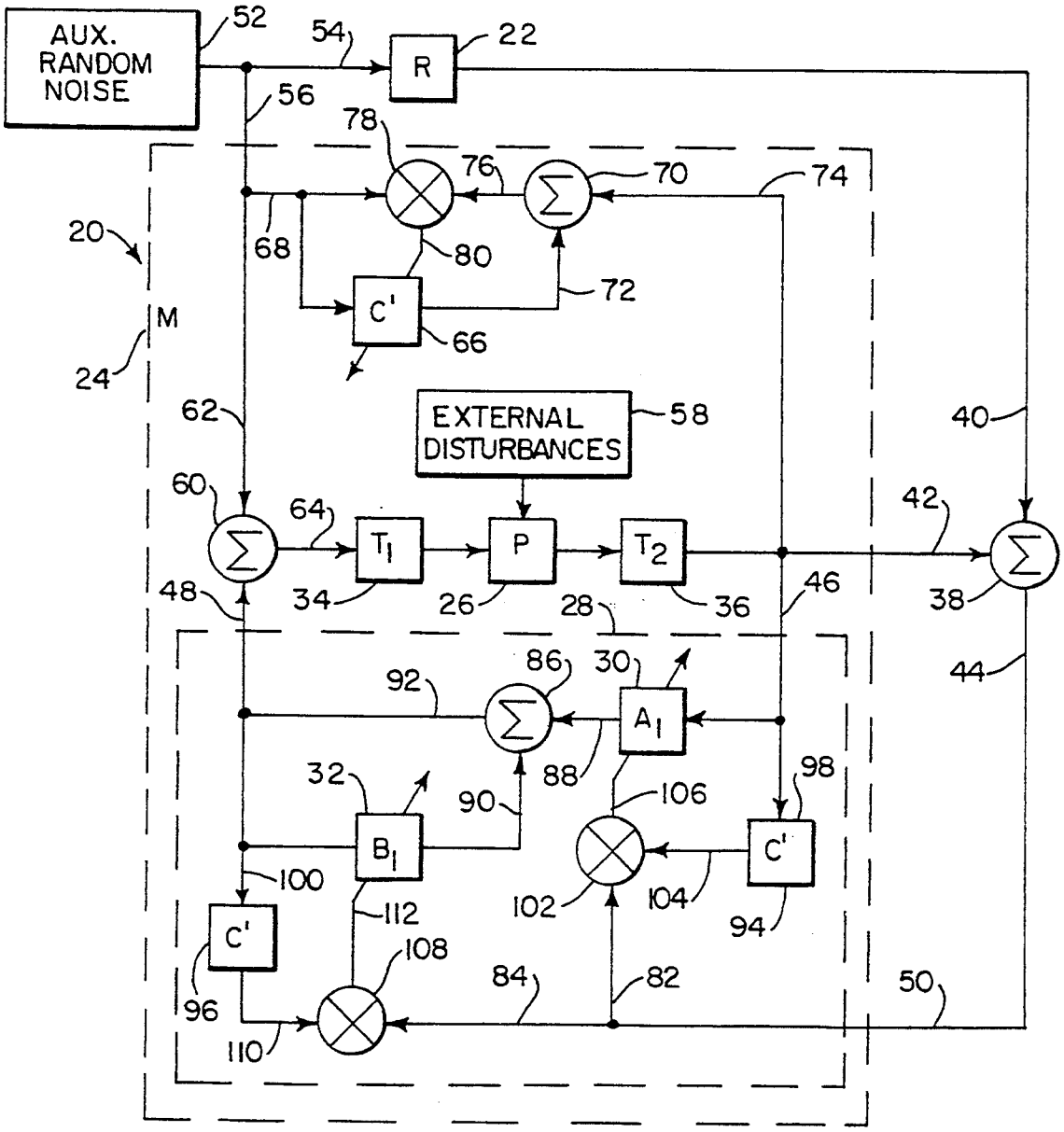
FIG. 1 is a schematic illustration of an active acoustic system in accordance with the invention.

FIG. 1 shows an active acoustic system 20 including a model reference R at 22 having a selectably programmable response, for example *Adaptive Control,* Astrom and Wittenmark, Lund Institute of Technology, Addison-Wesley Publishing Company, Reading, Mass., 1989, Chapter 4, pages 105–162. The model reference is selected or programmed to have a desired response, e.g. in a vibration application to have a given damping characteristic response. System 20 further includes an active model M at 24 including in combination an acoustic path P at 26 and an adaptive filter 28 such that the combination of acoustic path 26 and adaptive filter 28 adaptively models model reference 22 such that the combined response of acoustic path 26 and adaptive filter 28 provides an active model response matching the response of model reference 22. Adaptive filter 28 is preferably an infinite impulse response, IIR, filter as in the above noted incorporated patents, preferably provided by an RLMS (recursive least mean square) filter including LMS (least mean square) algorithm filter $A_1$ at 30 and LMS algorithm filter $B_1$ at 32. In another embodiment, filter 28 is provided by a finite impulse response, FIR, filter.

A first transducer $T_1$ at 34, e.g. a loudspeaker, shaker, force motor, or other acoustic actuator, is provided for introducing an acoustic wave to acoustic path 26. A second transducer $T_2$ at 36, e.g. a microphone, accelerometer, load cell, velocity sensor such as a geophone, or other acoustic sensor, is provided for sensing the response of the acoustic path. A summer 38 sums the outputs 40 and 42 of model reference 22 and active model 24, respectively, and provides the resultant sum as an error signal 44. Adaptive filter 28 has a filter input 46 from transducer 36, a filter output 48 to transducer 34, and an error input 50 from summer 38. The input 46 to adaptive filter 28 is also provided as the output 42 of active model 24 to summer 38.

An auxiliary noise source 52 introduces auxiliary noise to model reference 22 at input 54 and to active model 24 at input 56. The auxiliary noise is random and uncorrelated to the external disturbances 58 to which the acoustic path is subject. In preferred form, and as in incorporated U.S. Pat. No. 4,677,076, the auxiliary noise is provided by a Galois sequence, *Number Theory In Science And Communications,* M. R. Schroeder, Berlin: Springer-Verlag, 1984, pages 252–261, though other random noise sources may be used to provide the uncorrelated sound or vibration noise signal. The Galois sequence is a pseudorandom sequence that repeats after $2^M-1$ points, where M is the number of stages in a shift register. The Galois sequence is preferred because it is easy to calculate and can easily have a period much longer than the response time of the system.

Summer 60 sums the output 48 of adaptive filter 28 and the auxiliary noise at 62 from auxiliary noise source 52, and provides the resultant sum at 64 to transducer 34. Another adaptive filter C at 66 has a filter input 68 receiving auxiliary noise from auxiliary noise source 52, comparably to adaptive filter 142 in incorporated U.S. Pat. No. 4,677,676. Summer 70 sums the output 72 of adaptive filter 66 and the output at 74 of transducer 36, and supplies the resultant sum at 76 as an error input to adaptive filter 66. Multiplier 78 multiplies the output of auxiliary noise source 52 at filter input 68 with the output 76 of summer 70 and supplies the resultant product at 80 as a weight update signal to C filter 66. The filter input 68 to C filter 66 is provided from the input 56 to active model 24. C filter 66 is preferably an LMS algorithm filter.

The $A_1$ and $B_1$ adaptive algorithm filters 30 and 32 each have an error input 82 and 84, respectively, from the output 44 of summer 38. Summer 86 sums the outputs 88 and 90 of filters 30 and 32, respectively, and supplies the resultant sum at 92 as an input at 48 to summer 60 for summing with the auxiliary noise. A copy C′ of filter 66 is provided in filter 28 at 94, and another copy C′ of filter 66 is provided in filter 28 at 96, as in incorporated U.S. Pat. No. 4,677,676. C′ copy 94 of C filter 66 has an input 98 from transducer 36. C′ copy 96 of C filter 66 has an input 100 from the output 92 of summer 86. Multiplier 102 multiplies the output 104 of C′ copy 94 with the output of summer 38 and supplies the resultant product at 106 as a weight update signal to the $A_1$ filter 30. Multiplier 108 multiplies the output 110 of C′ copy 96 with the output of summer 38 and supplies the resultant product at 112 as a weight update signal to the B filter 32.

Figure 2:
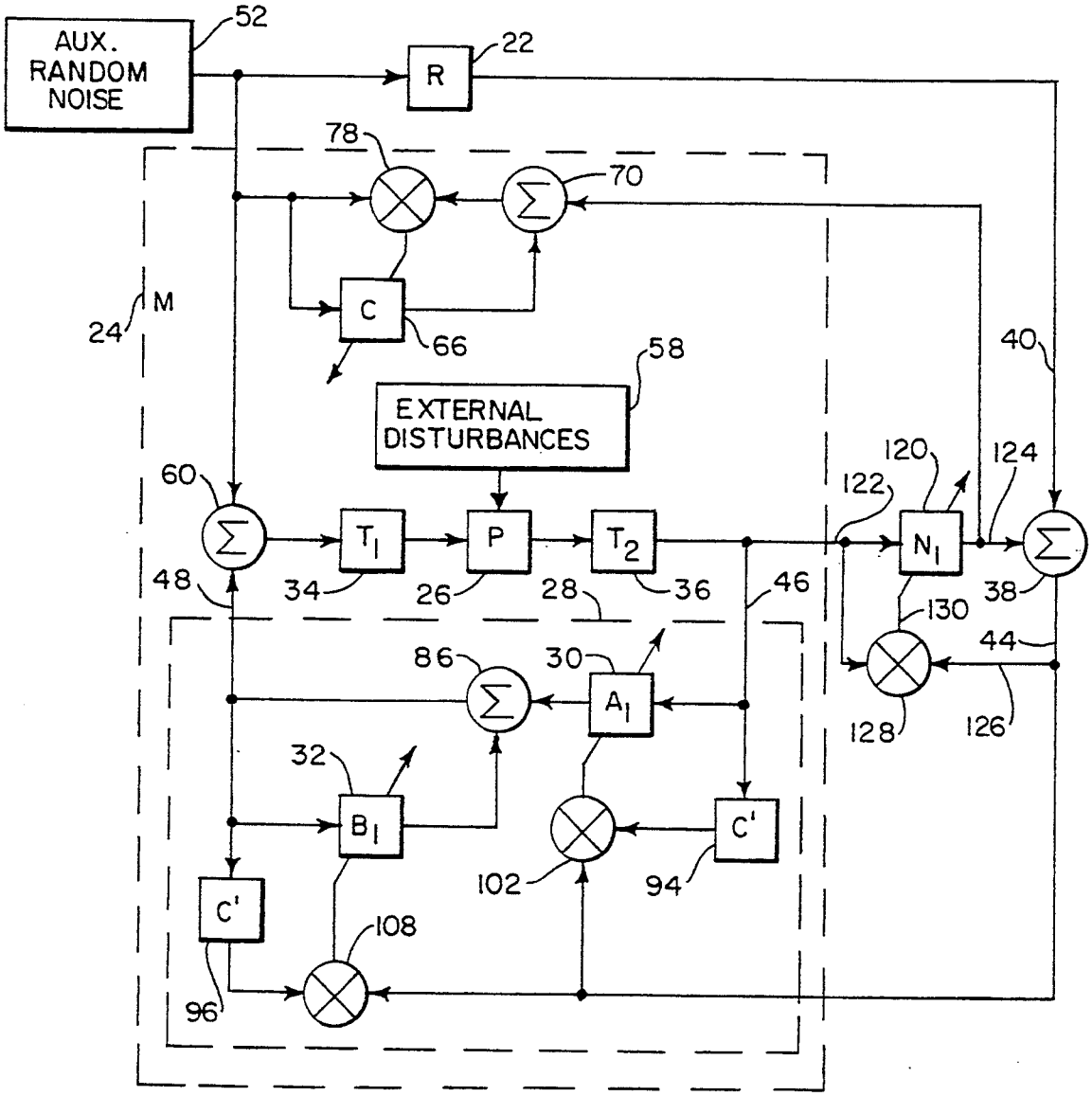
FIG. 2 is like FIG. 1 and shows a further embodiment.

FIG. 2 shows a further embodiment, and uses like reference numerals from FIG. 1 where appropriate to facilitate understanding. In FIG. 2, another adaptive filter $N_1$ at 120 has a filter input 122 from the output of acoustic path P, a filter output 124 to summer 38, and an error input 126 from the output of summer 38. Multiplier 128 multiplies the input 122 to filter 120 with the output of summer 38 and provides the resultant product at 130 as a weight update signal to filter 120.

The product of active model M at 24 and adaptive filter $N_1$ at 120 models and converges to model reference R, i.e.

$$N \cdot N_1 = R \quad \text{Equation 1}$$

Thus, adaptive filter $N_1$ models the quotient of model reference R and active model M, i.e.

$$N_1 = R/M \quad \text{Equation 2}$$

The inclusion of adaptive filter $N_1$ to model the quotient of the model reference R and the active model M improves matching thereof, particularly the filter gains.

Figure 3:
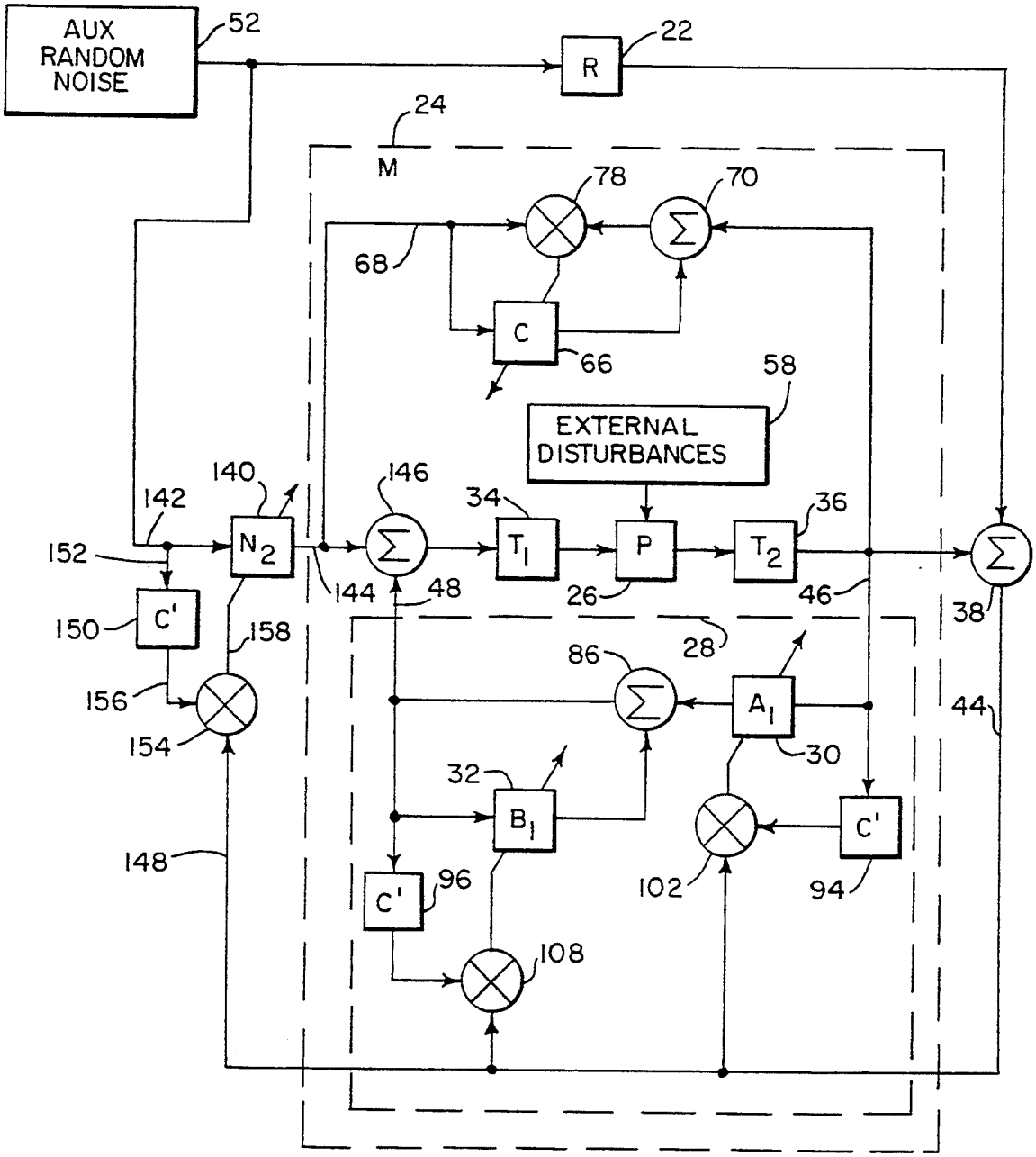
FIG. 3 is like FIG. 1 and shows a further embodiment.

FIG. 3 shows a further embodiment, and uses like reference numerals from FIG. 1 where appropriate to facilitate understanding. In FIG. 3, an adaptive filter $N_2$ at 140 has a filter input 142 receiving input noise, a filter output 144 to the input of the acoustic path P through summer 146, and an error input 148 from the output of summer 38. The output 144 of adaptive filter 140 is also provided to filter input 68 of C filter 66. A C′ copy 150 of C filter 66 has an input 152 from the input 142 to adaptive filter 140. Multiplier 154 multiplies the output 156 of C′ copy 150 with the output of summer 38 and supplies the resultant product at 158 as a weight update signal to adaptive filter 140.

In FIG. 3, the product of adaptive filter $N_2$ and active model M models and converges to model reference R, i.e.

$$N_2 \cdot M = R \quad \text{Equation 3}$$

Thus, adaptive filter $N_2$ models the quotient of the model reference R and active model M, i.e.

$$N_2 = R/M \quad \text{Equation 4}$$

The inclusion of adaptive filter $N_2$ to model the quotient of model reference R and the active model M improves matching thereof, particularly the filter gains.

Figure 4:
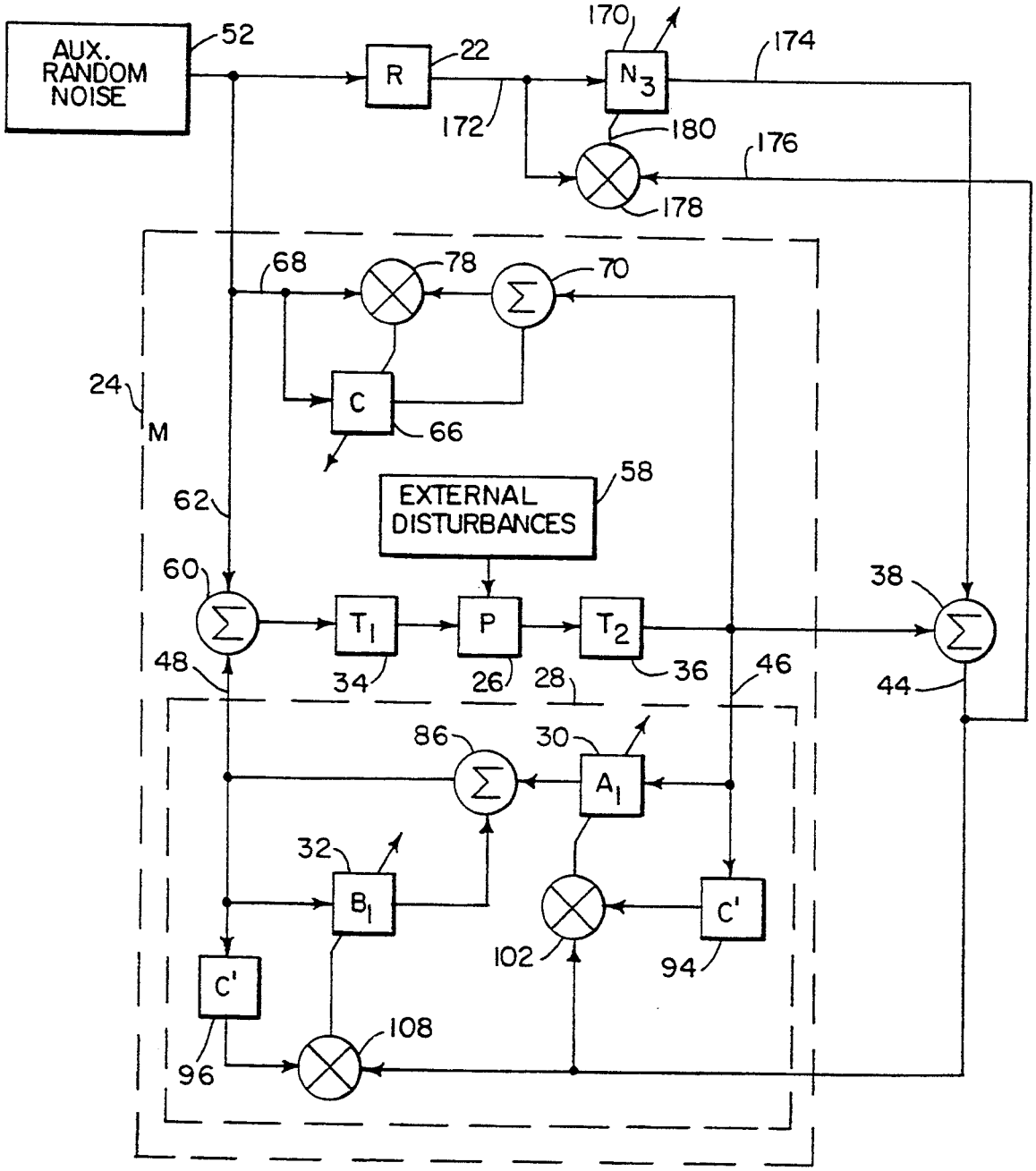
FIG. 4 is like FIG. 1 and shows a further embodiment.

FIG. 4 shows a further embodiment, and uses like reference numerals from FIG. 1 where appropriate to facilitate understanding. In FIG. 4, an adaptive filter $N_3$ at 170 has a filter input 172 from the output of model reference 22, a filter output 174 to summer 38, and an error input 176 from the output of summer 38. Multiplier 178 multiplies the input 172 to filter 170 with the output of summer 38 and provides the resultant product at 180 as a weight update signal to adaptive filter 170.

In FIG. 4, the product of model reference R and adaptive filter $N_3$ models and converges to active model M, and likewise active model M models and converges to the product of model reference R and adaptive filter $N_3$, i.e.

$$R \cdot N_3 = M \quad \text{Equation 5}$$

Thus, adaptive filter $N_3$ models the quotient of active model M and model reference R, i.e.

$$N_3 = M/R \quad \text{Equation 6}$$

The inclusion of adaptive filter $N_3$ to model the quotient of active model M and model reference R improves matching thereof, particularly the filter gains.

Figure 5:
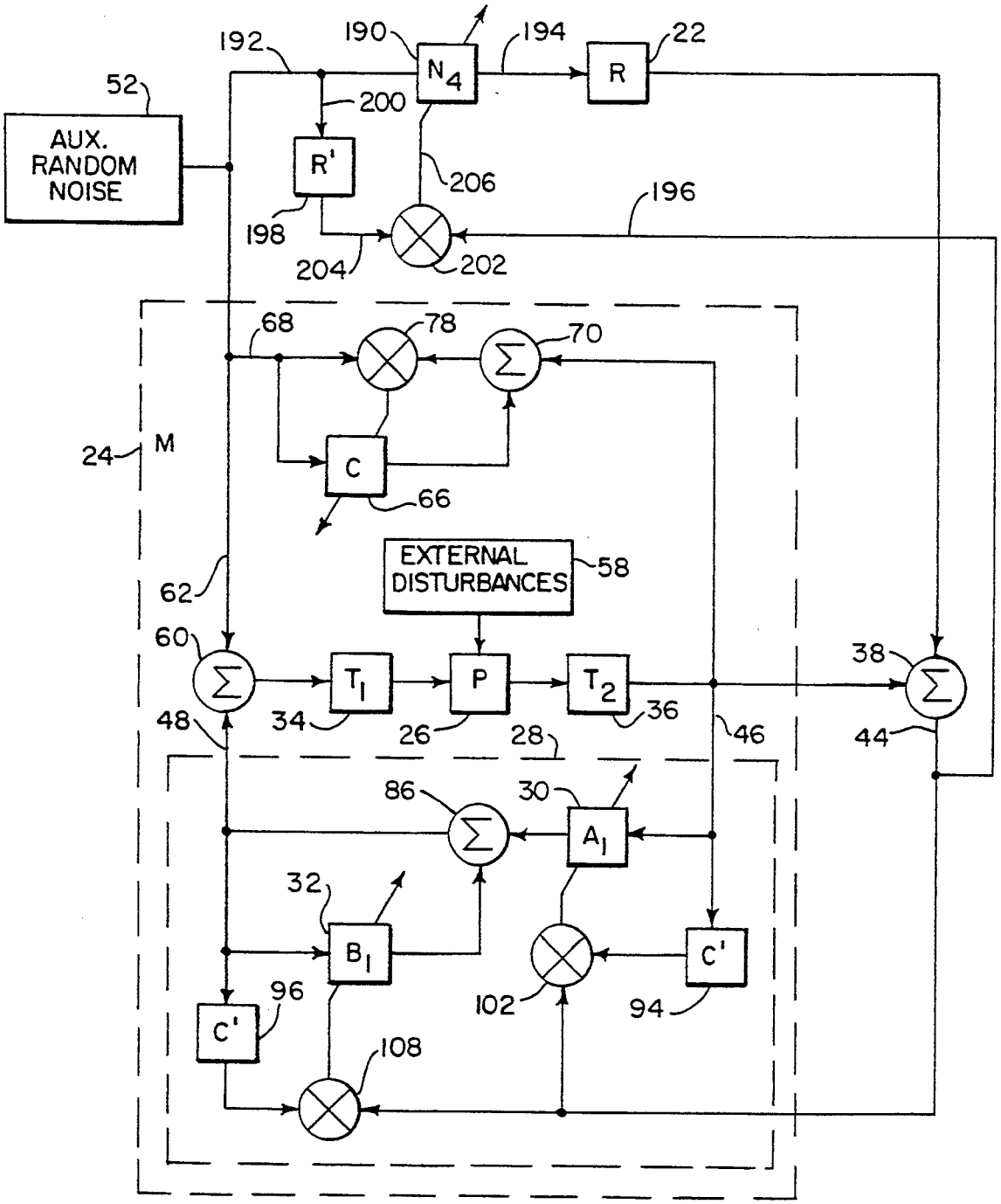
FIG. 5 is like FIG. 1 and shows a further embodiment.

FIG. 5 shows a further embodiment, and uses like reference numerals from FIG. 1 where appropriate to facilitate understanding. In FIG. 5, an adaptive filter $N_4$ at 190 has a filter input 192 receiving input noise, a filter output 194 to the input of model reference 22, and an error input 196 from the output of summer 38. A copy R′ of the model reference R is provided at 198 and has an input 200 from the input 192 to adaptive filter 190. Multiplier 202 multiplies the output 204 of R′ copy 198 with the output of summer 38 and supplies the resultant product at 206 as a weight update signal to adaptive filter 190.

In FIG. 5, the product of adaptive filter $N_4$ and model reference R models and converges to active model M, and likewise active model M models and converges to the product of adaptive model $N_4$ and model reference R, i.e.

$$N_4 = M/R \quad \text{Equation 7}$$

Thus, adaptive filter $N_4$ models the quotient of active model M and model reference R, i.e.

$$N_4 = M/R \quad \text{Equation 8}$$

The inclusion of adaptive filter $N_4$ to model the quotient of active model M and model reference R improves matching thereof, particularly the filter gains.

Figure 6:
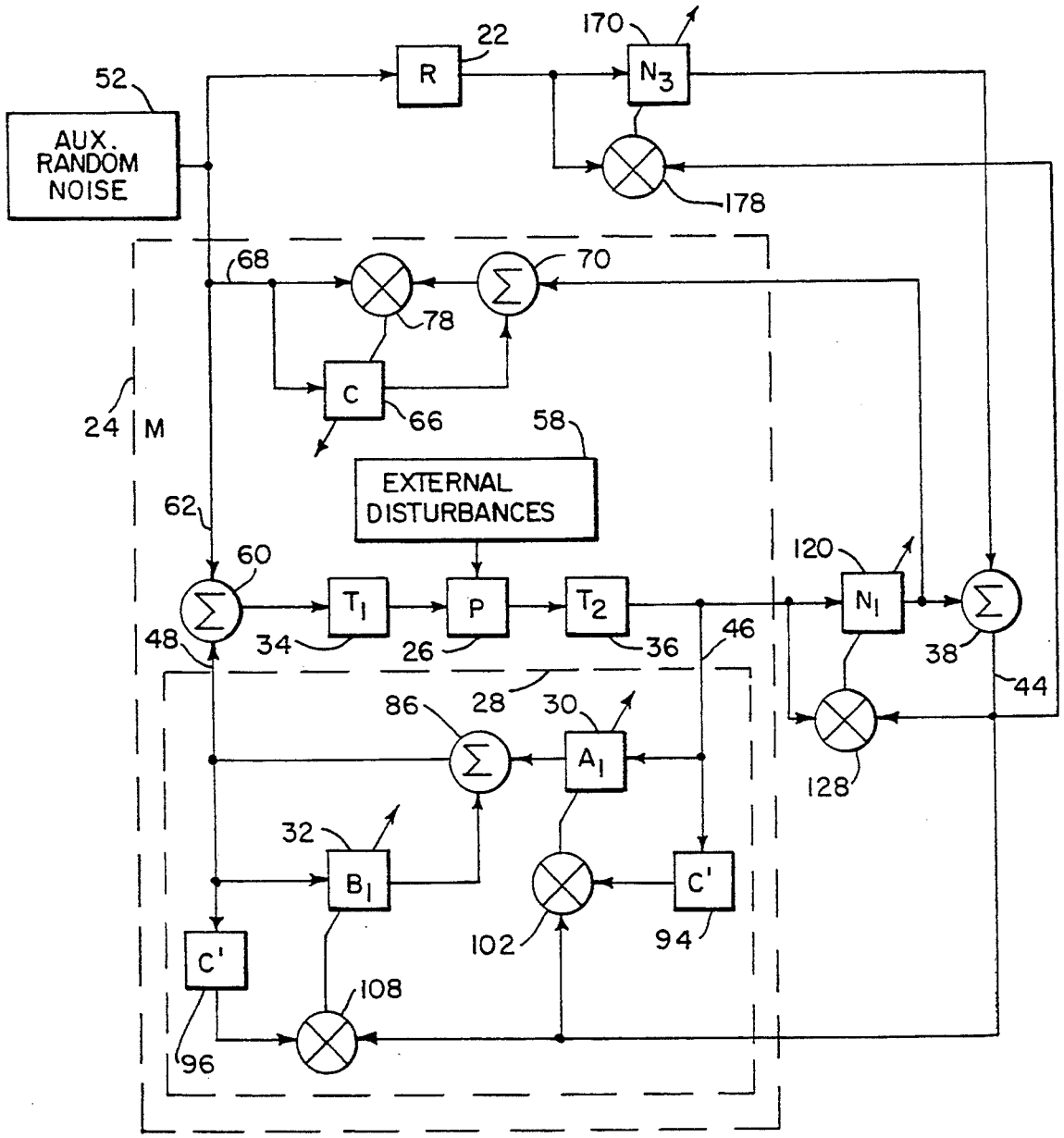
FIG. 6 is like FIGS. 2 and 4 and shows a further embodiment.

FIG. 6 shows a further embodiment, and uses like reference numerals from FIGS. 2 and 4 where appropriate to facilitate understanding. In FIG. 6, the system of FIG. 2 is provided with another adaptive N filter in accordance with FIG. 4, to provide a combination of $N_1$ and $N_3$ such that $$R \cdot N_3 = M \cdot N_1 \quad \text{Equation 9}$$

Thus, the model reference R is further factored by $N_3$, and $N_1$ models the quotient of such further factored model reference and the active model M, i.e.

$$N_1 = \frac{R \cdot N_3}{M} \quad \text{Equation 10}$$

Likewise, active model M is further factored by $N_1$, and $N_3$ models the quotient of such further factored active model and the model reference R, i.e.

$$N_3 = \frac{M \cdot N_1}{R} \quad \text{Equation 11}$$

Figure 7:
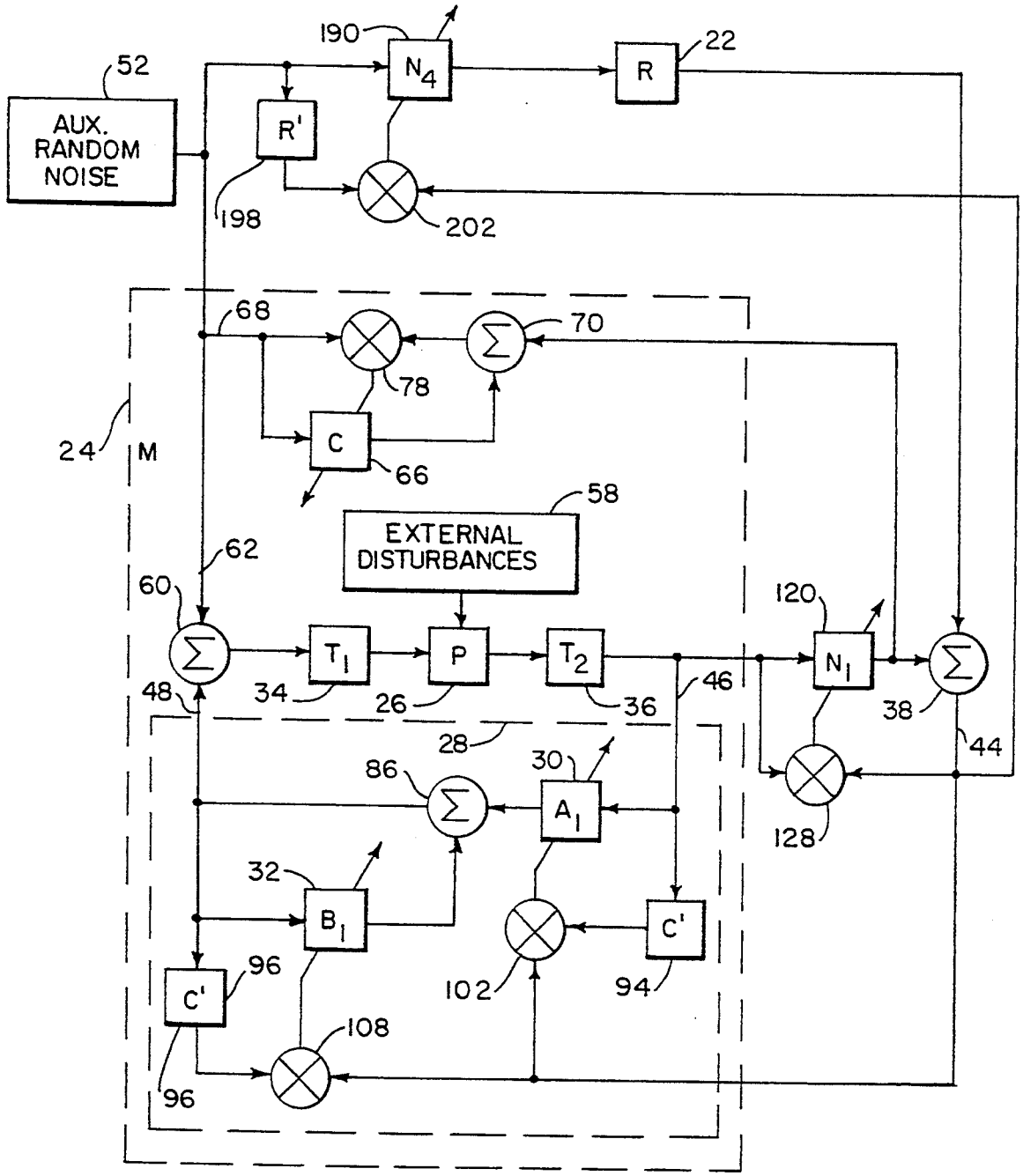
FIG. 7 is like FIGS. 2 and 5 and shows a further embodiment.

FIG. 7 shows a further embodiment, and uses like reference numerals from FIGS. 2 and 5 where appropriate to facilitate understanding. In FIG. 7, the system of FIG. 2 is provided with another adaptive N filter in accordance with FIG. 5, to provide a combination of $N_1$ and $N_4$ such that $$N_4 \cdot R = M \cdot N_1 \quad \text{Equation 12}$$

Thus, the model reference R is further factored by $N_4$, and $N_1$ models the quotient of such further factored model reference and the active model M, i.e.

$$N_1 = \frac{N_4 \cdot R}{M} \quad \text{Equation 13}$$

Likewise, active model M is further factored by $N_1$, and $N_4$ models the quotient of such further factored active model and the model reference R, i.e.

$$N_4 = \frac{M \cdot N_1}{R} \quad \text{Equation 14}$$

Figure 8:
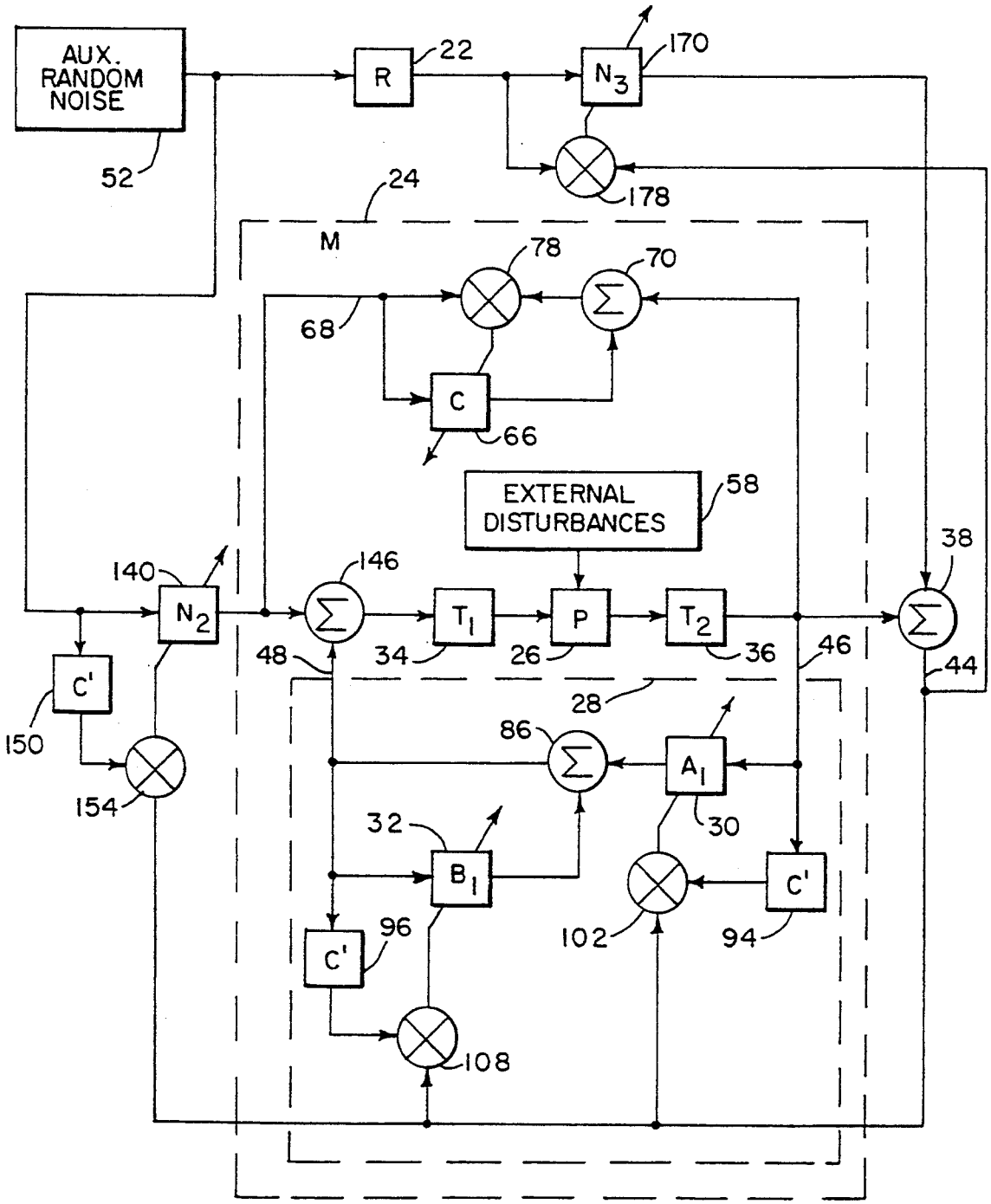
FIG. 8 is like FIGS. 3 and 4 and shows a further embodiment.

FIG. 8 shows a further embodiment, and uses like reference numerals from FIGS. 3 and 4 where appropriate to facilitate understanding. In FIG. 8, the system of FIG. 3 is provided with another adaptive N filter in accordance with FIG. 4, to provide a combination of $N_2$ and $N_3$ such that $$R \cdot N_3 = N_2 \cdot M \quad \text{Equation 15}$$

Thus, the model reference R is further factored by $N_3$, and $N_2$ models the quotient of such further factored model reference and the active model M, i.e.

$$N_2 = \frac{R \cdot N_3}{M} \quad \text{Equation 16}$$

Likewise, active model M is further factored by $N_2$, and $N_3$ models the quotient of such further factored active model and the model reference R, i.e.

$$N_3 = \frac{N_2 \cdot M}{R} \quad \text{Equation 17}$$

Figure 9:
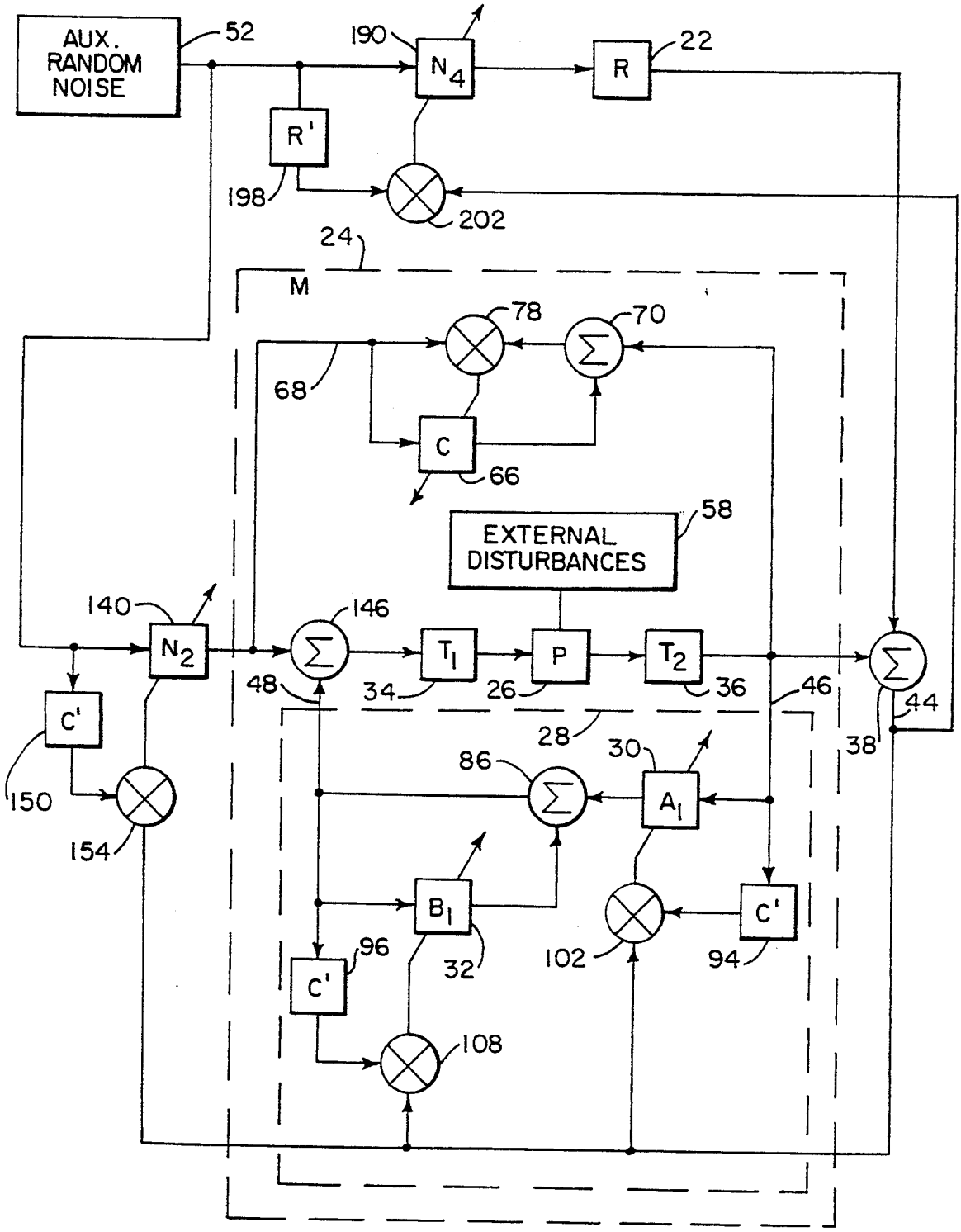
FIG. 9 is like FIGS. 3 and 5 and shows a further embodiment.

FIG. 9 shows a further embodiment, and uses like reference numerals from FIGS. 3 and 5 where appropriate to facilitate understanding. In FIG. 9, the system of FIG. 3 is provided with another adaptive N filter in accordance with FIG. 5, to provide the combination of $N_2$ and $N_4$ such that $$N_4 \cdot R = N_2 \cdot M \quad \text{Equation 18}$$

Thus, the model reference R is further factored by $N_4$, and $N_2$ models the quotient of such further factored model reference and the active model M, i.e.

$$N_2 = \frac{N_4 \cdot R}{M} \quad \text{Equation 19}$$

Likewise, active model M is further factored by $N_2$, and $N_4$ models the quotient of such further factored active model and the model reference R, i.e.

$$N_4 = \frac{N_2 \cdot M}{R} \quad \text{Equation 20}$$

In FIGS. 2–9, each of adaptive filters $N_1$, $N_2$, $N_3$, $N_4$ is preferably an FIR adaptive filter, preferably provided by an LMS algorithm filter. In an alternate embodiment, such filters are IIR filters, preferably RLMS filters.

Figure 10:
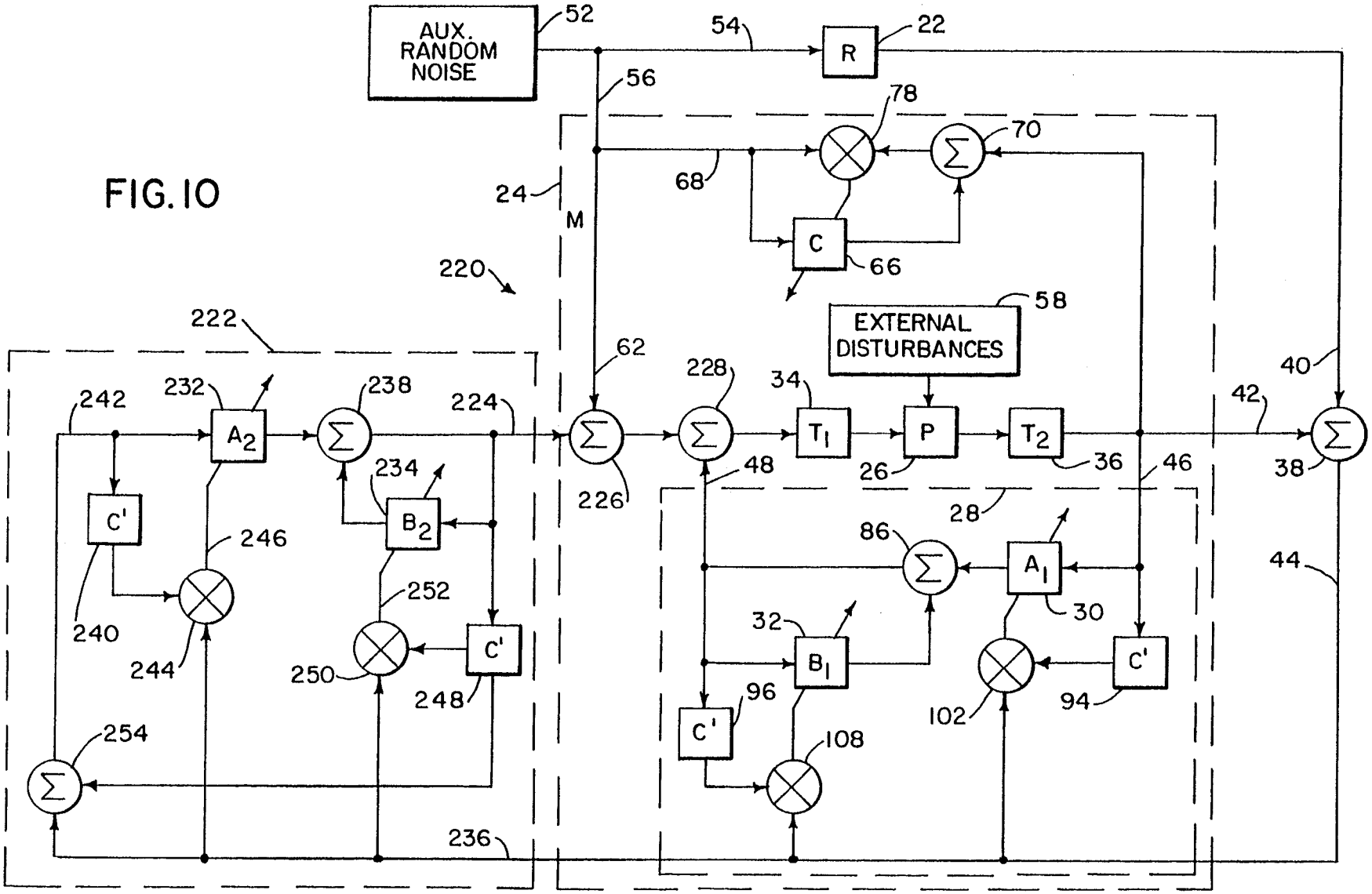
FIG. 10 is like FIG. 1 and shows a further embodiment.

FIG. 10 shows a further embodiment, and uses like reference numerals from FIG. 1 where appropriate to facilitate understanding. FIG. 10 shows an active acoustic attenuation system 220 incorporating the system of FIG. 1 and additionally attenuating or canceling an input acoustic wave. Transducer 34 provides an output transducer introducing a canceling acoustic wave to attenuate the input acoustic wave and yield an attenuated output acoustic wave. Transducer 36 provides an error transducer sensing the output acoustic wave. Adaptive filter 222 outputs a correction signal at 224 to transducer 34 to introduce the canceling acoustic wave. Summer 226 sums the auxiliary random noise from source 52 and the output 224 of adaptive filter 222. Summer 228 sums the output 48 of adaptive filter 28 and the output of summer 226 and supplies the resultant sum to transducer 34. The summation of the auxiliary random noise at 62 and filter outputs 224 and 48 may be split into two stages as shown at summers 226 and 228, or may be combined in a single summation step, i.e. the summation may be provided by a pair of two-input summers or by a single three-input summer.

Adaptive filter 222 is preferably an IIR filter, as shown at 40 in incorporated U.S. Pat. No. 4,677,676, preferably an RLMS algorithm filter including an LMS algorithm filter $A_2$ at 232, and an LMS algorithm filter $B_2$ at 234, each having an error input 236 from the output of summer 38. Summer 238 sums the outputs of $A_2$ and $B_2$ algorithm filters 232 and 234 and supplies the resultant sum at filter output 224 to the input of summer combination 226, 228. A copy C' of C filter 66 is provided at 240 and has an input from the input 242 to the $A_2$ filter 232. Multiplier 244 multiplies the output of C' copy 240 and the output of summer 38 and supplies the resultant product at 246 as a weight update signal to algorithm filter 232. Another copy C' of C filter 66 is provided at 248 and has an input from the input to $B_2$ filter 234 from the output of summer 238. Multiplier 250 multiplies the output of C' copy 248 with the output of summer 38 and supplies the resultant product at 252 as a weight update signal to algorithm filter 234.

Summer 254 sums the output of C' copy 248 and the output of summer 38, and supplies the resultant sum as the input at 242 to adaptive algorithm filter 232. This is known as the equation error form, as noted in incorporated allowed U.S. application Ser. No. 07/835,721. This form is useable for a correlated input acoustic wave, eliminating the need for an input transducer such as 10 in incorporated U.S. Pat. No. 4,677,676. Correlated means periodic, band-limited, or otherwise having some predictability. In an alternate embodiment, the input signal at 242 is provided by an input transducer, such as an input microphone or accelerometer, or some signal which is itself correlated to the input acoustic wave, e.g. from a tachometer.

In further alternatives, the embodiments in FIGS. 2–9 are used in combination in the system of FIG. 10. In using the systems of FIGS. 3, 8 or 9 in FIG. 10, it is preferred that $N_2$ be provided in series between summers 226 and 228.

Figure 11:
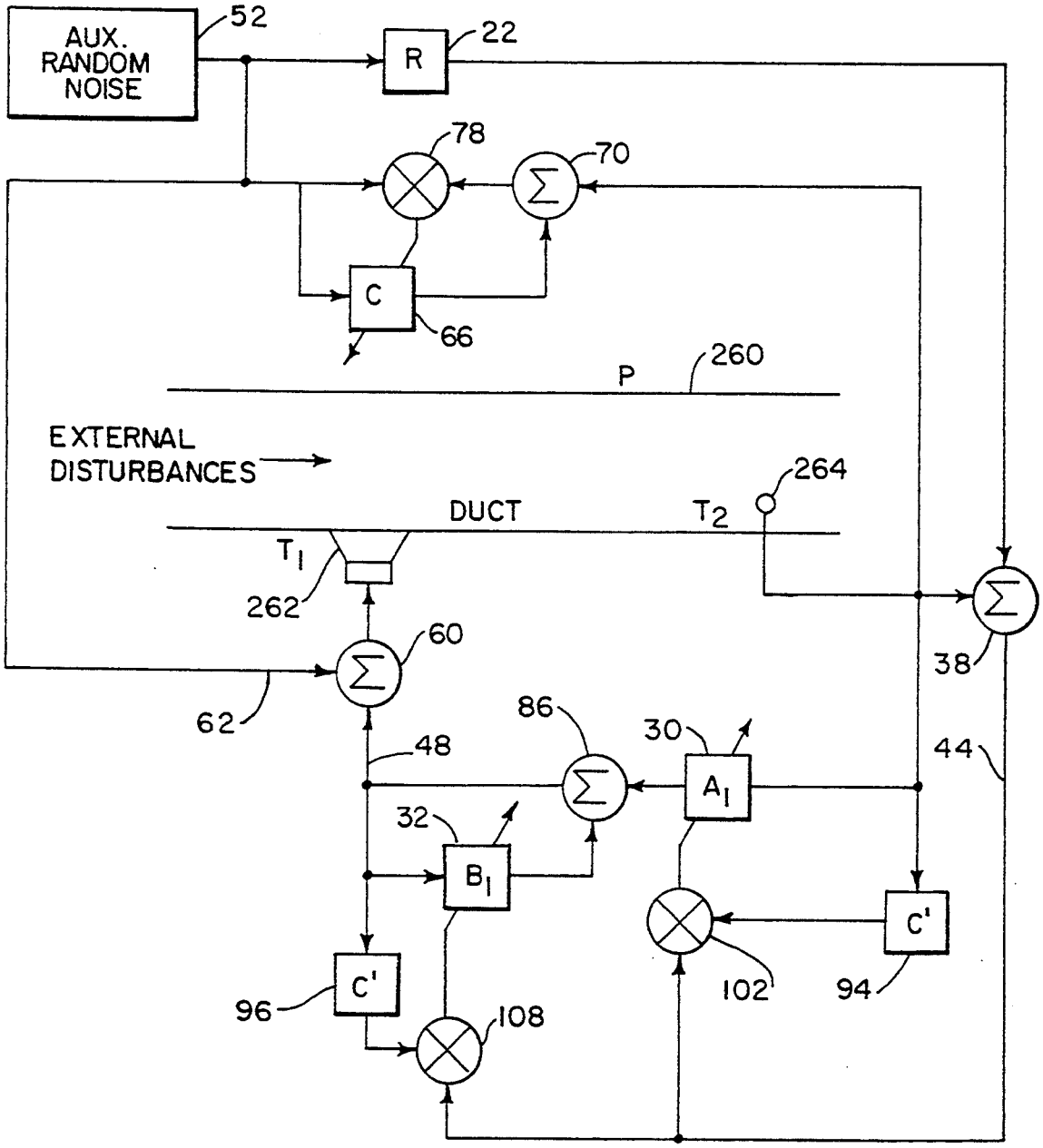
FIG. 11 further illustrates the system of FIG. 1.

FIG. 11 shows a further embodiment, and uses like reference numerals from FIG. 1 where appropriate to facilitate understanding. FIG. 11 shows the system of FIG. 1 in a sound application where the acoustic path P is provided by duct 260 having transducer $T_1$ provided by loudspeaker 262, and transducer $T_2$ provided by microphone 264.

Figure 12:
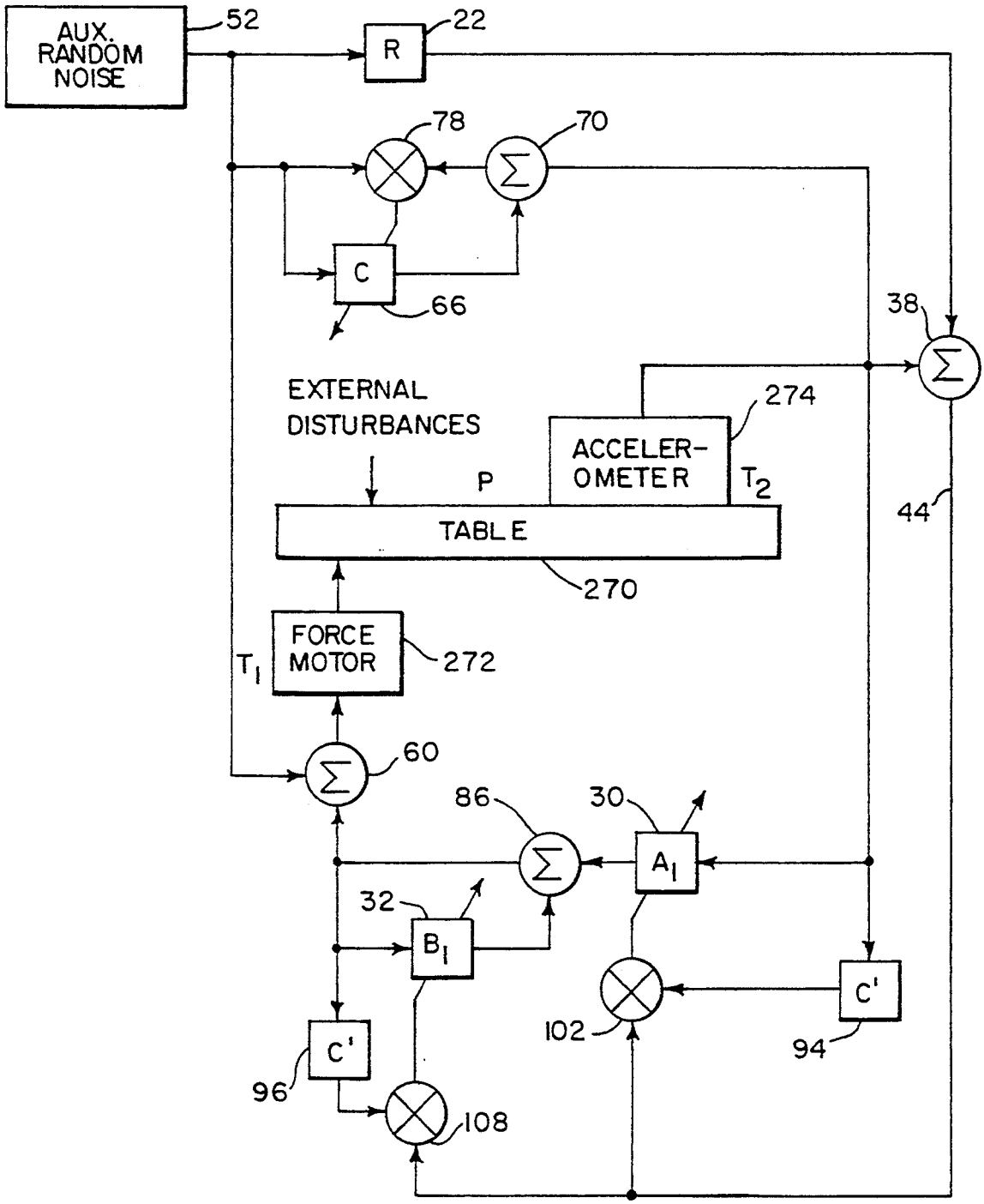
FIG. 12 further illustrates the system of FIG. 1 in another embodiment.

FIG. 12 shows a further embodiment, and uses like reference numerals from FIG. 1 where appropriate to facilitate understanding. FIG. 12 shows the system of FIG. 1 in a vibration application where the acoustic path P is provided by table 270 having transducer $T_1$ provided by shaker or force motor 272, and transducer $T_2$ provided by accelerometer 274.

Figure 13:
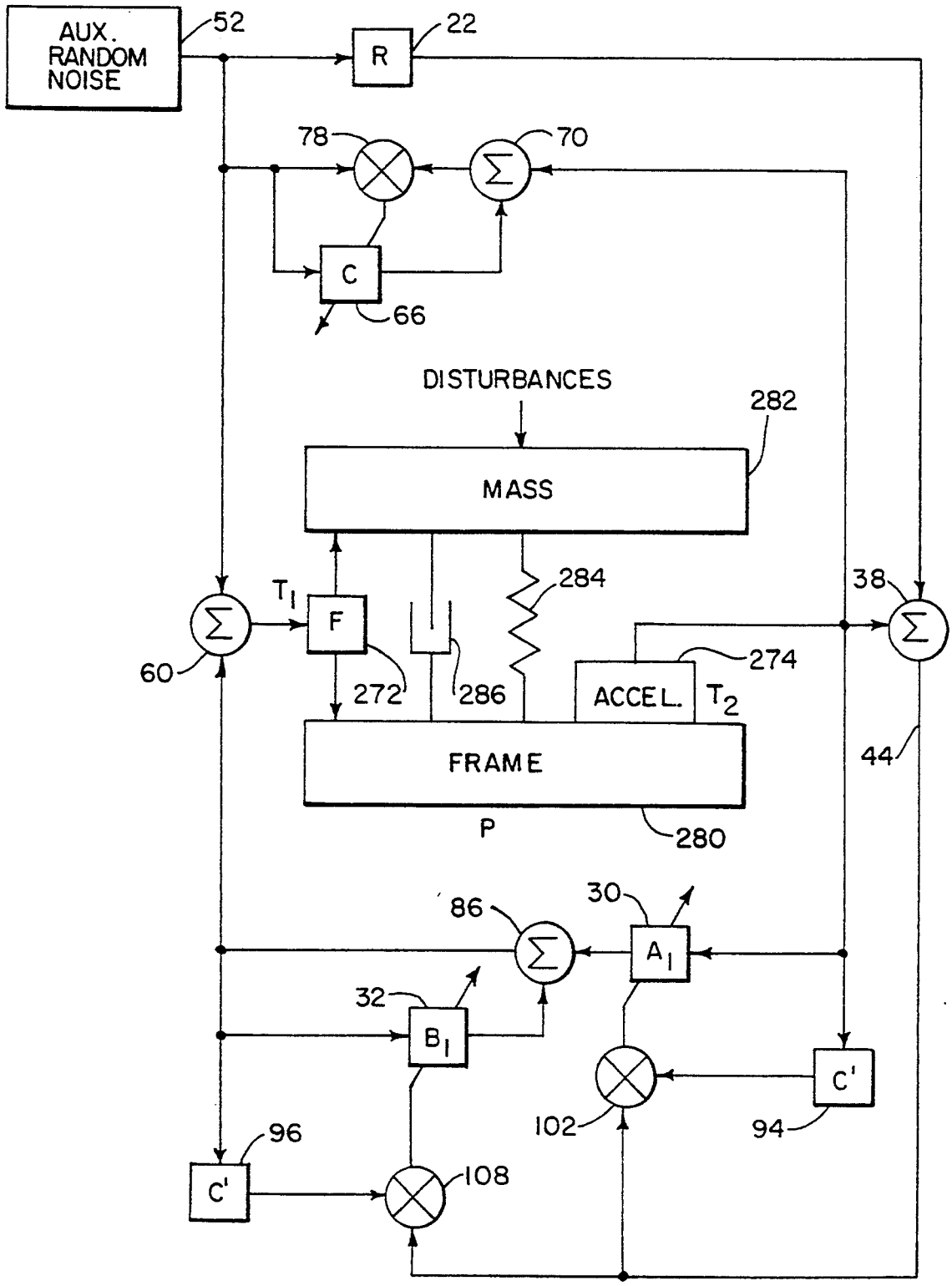
FIG. 13 is like FIG. 12 and shows a further embodiment.

FIG. 13 shows a further embodiment, and uses like reference numerals from FIG. 12 where appropriate to facilitate understanding. FIG. 13 shows the system of FIG. 12 in a force isolation application, for example active engine mounts in an automobile, truck or other vehicle, where the acoustic path P is the vehicle frame 280. A mass 282, such as the vehicle engine is mounted to the frame by engine mounts having a resilient spring factor 284, and a damping factor 286. Frame 280 is subject to external disturbances such as provided by the mass or engine 282, which for example may be the reciprocating piston movement within the engine. Force motor 272 applies controlled force between mass 282 and frame 280 to provide force isolation, isolating frame 280 from the force or disturbances of mass 282. One particularly desirable implementation of the system in FIG. 13 isolates a vehicle frame 280, and hence the vehicle passengers, from engine vibration, particularly at idle or low engine rpm. This eliminates the need for crankshaft counterweights to provide smooth vibration-free engine operation at idle. In a further embodiment of the system of FIG. 13, mass 282 is an inertial mass, and frame 280 is subject to disturbances. This latter implementation is also useful in engine mount applications.

Figure 14:
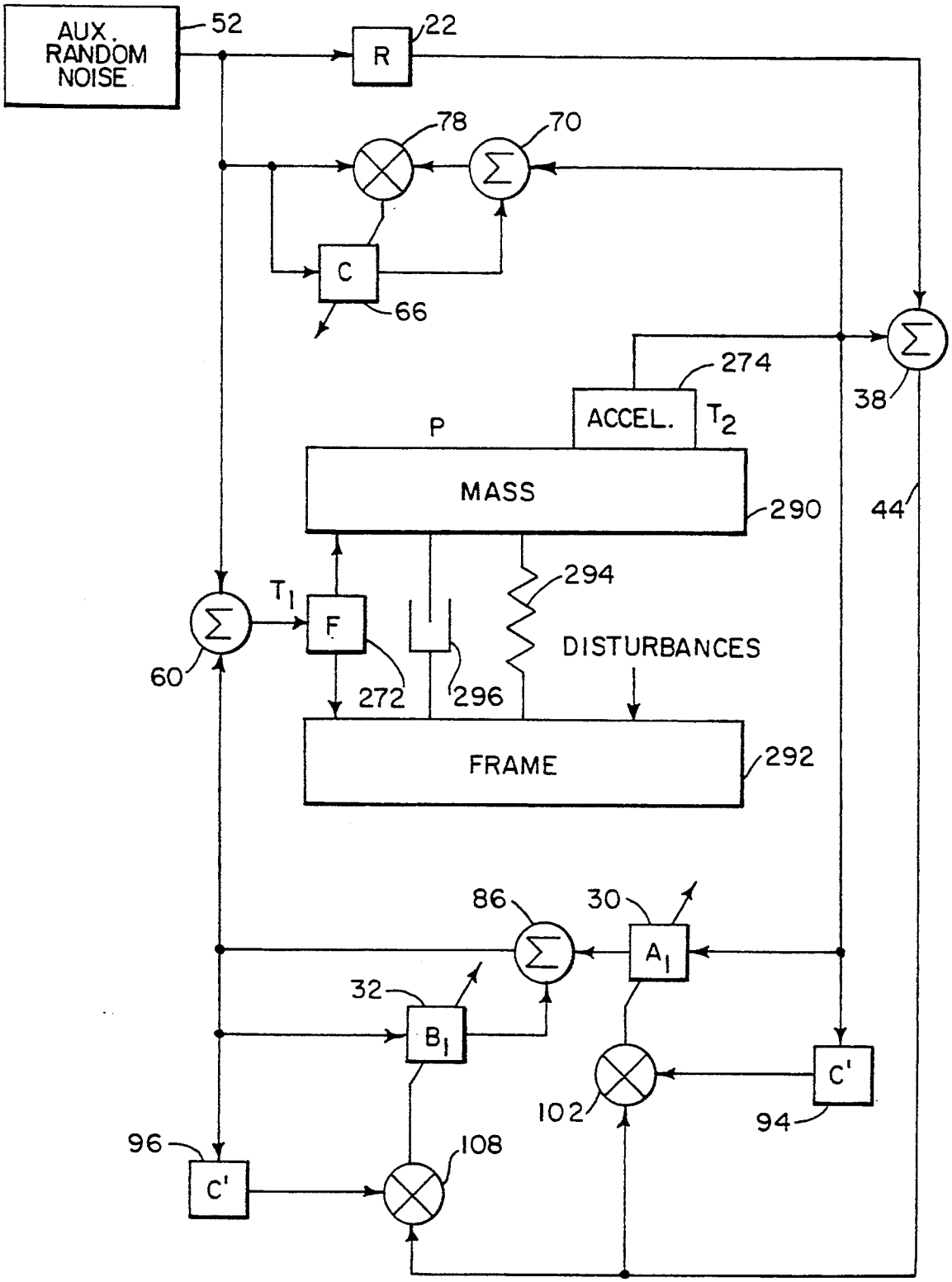
FIG. 14 is like FIG. 13 and shows a further embodiment.

FIG. 14 shows a further embodiment, and uses like reference numerals from FIG. 13 where appropriate to facilitate understanding. FIG. 14 shows the system of FIG. 13 in a vibration application for motion isolation, isolating a mass 290, such as a vehicle cab, from the motion of the vehicle frame 292 which is subject to external disturbances such as road bumps, etc. The acoustic path P is the mass 290, for example the vehicle cab which is mounted to the vehicle frame 292 by a suspension system including spring 294 and damping shock absorbers 296.

Figure 15:
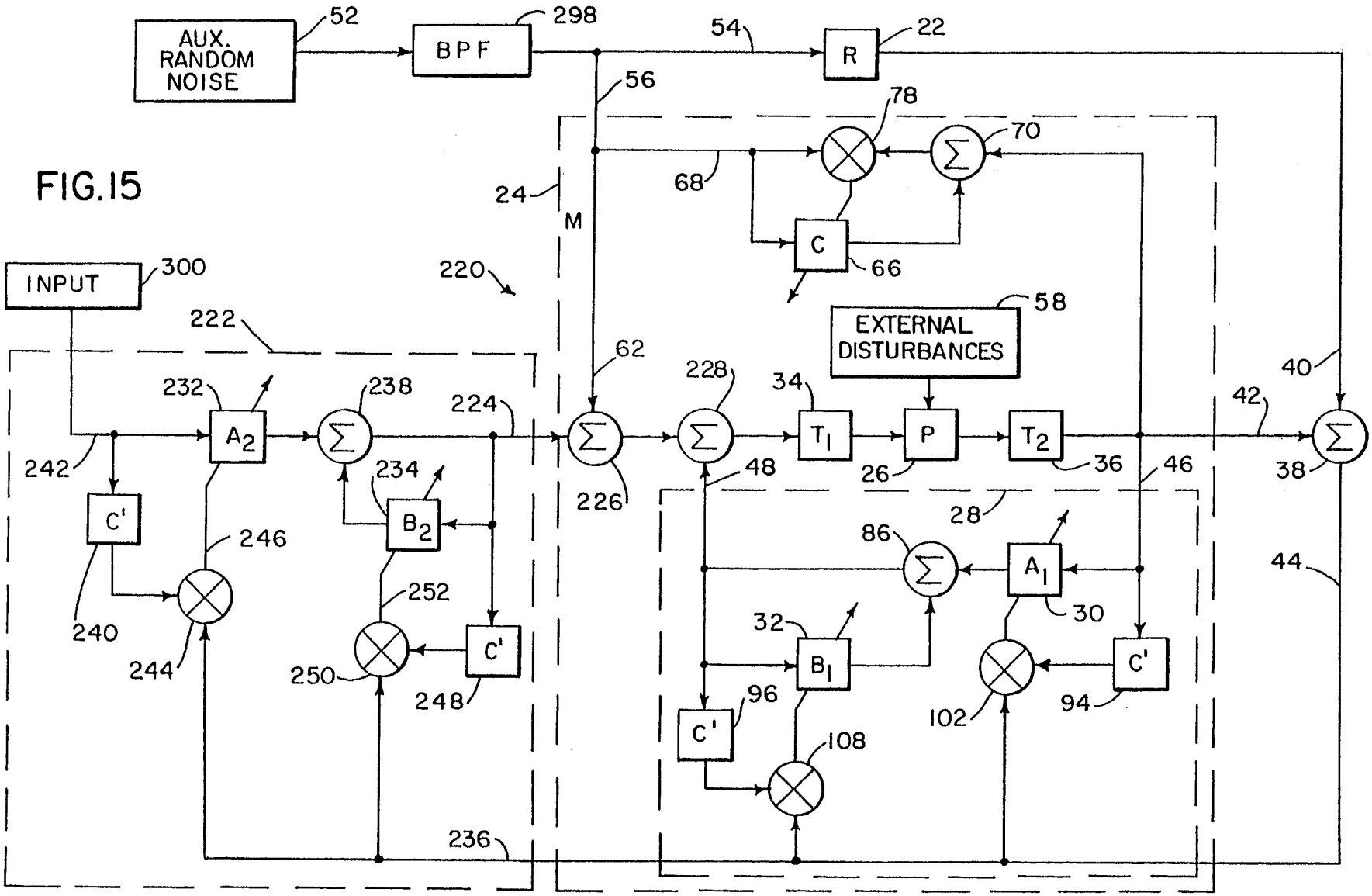
FIG. 15 is like FIG. 10 and shows a further embodiment.

FIG. 15 shows a further embodiment, and uses like reference numerals from FIG. 10 where appropriate to facilitate understanding. In the embodiment of FIG. 15, the auxiliary random noise signal from source 52 is filtered by a shaping bandpass filter 298 to provide a random noise signal with a desired power spectrum, to provide a tighter fit of active model M and model reference R as a function of frequency. In a further embodiment as also shown in FIG. 15, model input 242 is provided by a reference input signal from an input source 300, such as a tachometer or other acoustic sensor, which input signal is correlated to the external disturbances. In a further embodiment, model reference R can be calculated from or include a function of the controller parameters $A_1$, $B_1$ and/or the acoustic path P and/or the transducers $T_1$, $T_2$ In a further embodiment, filters $N_1$, $N_2$, $N_3$, $N_4$ can be calculated from or include a function of the controller parameters $A_1$, $B_1$ and/or the acoustic path P and/or the transducers $T_1$, $T_2$.

It is recognized that various equivalents, alternatives and modifications are possible within the scope of the appended claims.

We claim:

1. An active acoustic system comprising:

a model reference having a selectably programmable response;

an active model comprising in combination an acoustic path and an adaptive filter coupled in antiparallel feedback relation wherein the input of said adaptive filter receives the output of said acoustic path, and the output of said adaptive filter is supplied to the input of said acoustic path, such that the output of said acoustic path is fed back through said adaptive filter to the input of said acoustic path, and such that the combination of said acoustic path and said adaptive filter adaptively models said model reference such that the combined response of said acoustic path and said adaptive filter provides an active model response matching the response of said model reference.

2. The invention according to claim 1 comprising:

a first transducer introducing an acoustic wave to said acoustic path;

a second transducer sensing the response of said acoustic path;

a summer summing the outputs of said model reference and said active model and providing the resultant sum as an error signal;

said adaptive filter having a filter input from said second transducer, a filter output to said first transducer, and an error input from said summer.

3. The invention according to claim 2 comprising an auxiliary noise source introducing auxiliary noise to said active model.

4. The invention according to claim 3 wherein said acoustic path is subject to external disturbances, and said auxiliary noise is random and uncorrelated to said external disturbances.

5. An active acoustic system comprising:

a model reference having a selectably programmable response;

an active model comprising in combination an acoustic path and an adaptive filter such that the combination of said acoustic path and said adaptive filter adaptively models said model reference such that the combined response of said acoustic path and said adaptive filter provides an active model response matching the response of said model reference;

a first transducer introducing an acoustic wave to said acoustic path;

a second transducer sensing the response of said acoustic path;

a summer summing the outputs of said model reference and said active model and providing the resultant sum as an error signal;

said adaptive filter having a filter input from said second transducer, a filter output to said first transducer, and an error input from said summer;

an auxiliary noise source introducing auxiliary noise to said active model, wherein said acoustic path is subject to external disturbances, and said auxiliary noise is random and uncorrelated to said external disturbances, and wherein said auxiliary random noise is filtered by a shaping bandpass filter to provide a tightness of fit of said active model and said model reference as a function of frequency.

6. The invention according to claim 3 comprising a second summer summing the output of said adaptive filter and said auxiliary noise from said auxiliary noise source, and providing the resultant sum to said first transducer.

7. The invention according to claim 6 wherein the input to said adaptive filter input is also provided as the output of said active model to said first mentioned summer.

8. The invention according to claim 3 comprising a second adaptive filter having a filter input receiving said auxiliary noise, a copy of said second adaptive filter in said first mentioned adaptive filter, a second summer summing the output of said second adaptive filter and the output of said second transducer and supplying the resultant sum as an error input to said second adaptive filter.

9. The invention according to claim 8 comprising:

a third summer summing auxiliary noise from said auxiliary noise source and the output of said first adaptive filter and supplying the resultant sum to said first transducer;

wherein said first adaptive filter comprises first and second algorithm filters each having an error input from the output of said first mentioned summer;

a fourth summer summing the outputs of said first and second algorithm filters and supplying the resultant sum as an input to said third summer for summing with said auxiliary noise;

a first copy of said second adaptive filter having an input from said second transducer;

a second copy of said second adaptive filter having an input from the output of said fourth summer;

a first multiplier multiplying the output of said first copy with the output of said first summer and supplying the resultant product as a weight update signal to said first algorithm filter;

a second multiplier multiplying the output of said second copy with the output of said first summer and supplying the resultant product as a weight update signal to said second algorithm filter.

10. The invention according to claim 2 comprising a second adaptive filter having a filter input from an input to said active model, and a second summer summing the output of said second adaptive filter and the output of said second transducer and supplying the resultant sum as an error input to said second adaptive filter.

11. An active acoustic system comprising:

a model reference having a selectably programmable response;

an active model comprising in combination an acoustic path and an adaptive filter such that the combination of said acoustic path and said adaptive filter adaptively models said model reference such that the combined response of said acoustic path and said adaptive filter provides an active model response matching the response of said model reference;

a first transducer introducing an acoustic wave to said acoustic path;

a second transducer sensing the response of said acoustic path;

a summer summing the outputs of said model reference and said active model and providing the resultant sum as an error signal;

said adaptive filter having a filter input from said second transducer, a filter output to said first transducer, and an error input from said summer;

a second filter modeling the quotient of said model reference and said active model to improve matching thereof.

12. The invention according to claim 11 wherein said second filter is adaptive and has a filter input from the output of said acoustic path, a filter output to said summer, and an error input from the output of said summer.

13. The invention according to claim 11 wherein said second adaptive filter has a filter input receiving input noise, a filter output to the input of said acoustic path, and an error input from the output of said summer.

14. The invention according to claim 13 comprising:

a third adaptive filter having a filter input from the output of said second adaptive filter;

a second summer summing the output of said third adaptive filter and the output of said second transducer and supplying the resultant sum as an error input to said third adaptive filter;

a copy of said third adaptive filter having an input from the input to said second adaptive filter;

a multiplier multiplying the output of said copy with the output of said first summer and supplying the resultant product as a weight update signal to said second adaptive filter.

15. An active acoustic system comprising:

a model reference having a selectably programmable response;

an active model comprising in combination an acoustic path and an adaptive filter such that the combination of said acoustic path and said adaptive filter adaptively models said model reference such that the combined response of said acoustic path and said adaptive filter provides an active model response matching the response of said model reference;

a first transducer introducing an acoustic wave to said acoustic path;

a second transducer sensing the response of said acoustic path;

a summer summing the outputs of said model reference and said active model and providing the resultant sum as an error signal;

said adaptive filter having a filter input from said second transducer, a filter output to said first transducer, and an error input from said summer;

a second filter modeling the quotient of said active model and said model reference to improve matching thereof.

16. The invention according to claim 15 wherein said second filter is adaptive and has a filter input from the output of said model reference, a filter output to said summer, and an error input from the output of said summer.

17. The invention according to claim 15 wherein said second adaptive filter has a filter input receiving input noise, a filter output to the input of said model reference, and an error input from the output of said summer.

18. The invention according to claim 17 comprising:

a copy of said model reference having an input from the input to said second adaptive filter;

a multiplier multiplying the output of said copy with the output of said first summer and supplying the resultant product as a weight update signal to said second adaptive filter.

19. An active acoustic system comprising:

a model reference having a selectably programmable response;

an active model comprising in combination an acoustic path and an adaptive filter such that the combination of said acoustic path and said adaptive filter adaptively models said model reference such that the combined response of said acoustic path and said adaptive filter provides an active model response matching the response of said model reference;

a first transducer introducing an acoustic wave to said acoustic path;

a second transducer sensing the response of said acoustic path;

a summer summing the outputs of said model reference and said active model and providing the resultant sum as an error signal;

said adaptive filter having a filter input from said second transducer, a filter output to said first transducer, and an error input from said summer;

a second filter modeling the quotient of said model reference and said active model, and a third filter modeling the quotient of said active model and said model reference, to improve the matching of active model response to the response of said model reference.

20. The invention according to claim 19 wherein:

said second filter is adaptive and has a filter input from the output of said acoustic path, a filter output to said summer, and an error input from the output of said summer;

said third filter is adaptive and has a filter input from the output of said model reference, a filter output to said summer, and an error input from the output of said summer.

21. The invention according to claim 19 wherein:

said second filter is adaptive and has a filter input from the output of said acoustic path, a filter output to said summer, and an error input from the output of said summer;

said third filter is adaptive and has a filter input receiving input noise, a filter output to the input of said model reference, and an error input from the output of said summer.

22. The invention according to claim 19 wherein:

said second filter is adaptive and has a filter input receiving input noise, a filter output to the input of said acoustic path, and an error input from the output of said summer;

said third filter is adaptive and has a filter input from the output of said model reference, a filter output to said summer, and an error input from the output of said summer.

23. The invention according to claim 19 wherein:

said second filter is adaptive and has a filter input receiving input noise, a filter output to the input of said acoustic path, and an error input from the output of said summer;

said third filter is adaptive and has a filter input receiving input noise, a filter output to the input of said model reference, and an error input from the output of said summer.

24. An active acoustic attenuation system comprising:

an output transducer introducing a canceling acoustic wave to attenuate an input acoustic wave and yield an attenuated output acoustic wave;

an error transducer sensing said output acoustic wave;

a first adaptive filter outputting a correction signal to said output transducer to introduce the canceling acoustic wave;

a model reference having a selectably programmable response;

an active model comprising in combination the acoustic path between said output transducer and said error transducer and a second adaptive filter coupled in antiparallel feedback relation wherein the input of said second adaptive filter receives the output of said acoustic path, and the output of said second adaptive filter is supplied to the input of said acoustic path, such that the output of said acoustic path is fed back through said second adaptive filter to the input of said acoustic path, and such that the combination of said acoustic path and said second adaptive filter adaptively models said model reference such that the combined response of said acoustic path and said second adaptive filter provides an active model response matching the response of said model reference.

25. The invention according to claim 24 comprising a summer summing the outputs of said model reference and said active model and providing the resultant sum as an error signal, and wherein said second adaptive filter has a filter input from said error transducer, a filter output to said output transducer, and an error input from the output of said summer.

26. The invention according to claim 25 comprising a second summer summing the outputs of said first and second adaptive filters and supplying the resultant sum to said output transducer, and wherein said first adaptive filter has an error input from said first summer.

27. The invention according to claim 26 comprising:

an auxiliary noise source introducing auxiliary noise to said model reference and to said active model;

a third adaptive filter having a filter input receiving said auxiliary noise;

a third summer summing the output of said third adaptive filter and the output of said error transducer and supplying the resultant sum as an error input to said third adaptive filter.

28. An active acoustic attenuation system comprising:

an output transducer introducing a canceling acoustic wave to attenuate an input acoustic wave and yield an attenuated output acoustic wave;

an error transducer sensing said output acoustic wave;

a first adaptive filter outputting a correction signal to said output transducer to introduce the canceling acoustic wave;

a model reference having a selectably programmable response;

an active model comprising in combination the acoustic path between said output transducer and said error transducer and a second adaptive filter such that the combination of said acoustic path and said second adaptive filter adaptively models said model reference such that the combined response of said acoustic path and said second adaptive filter provides an active model response matching the response of said model reference;

a summer summing the outputs of said model reference and said active model and providing the resultant sum as an error signal, and wherein said second adaptive filter has a filter input from said error transducer, a filter output to said output transducer, and an error input from the output of said summer;

a second summer summing the outputs of said first and second adaptive filters and supplying the resultant sum to said output transducer, and wherein said first adaptive filter has an error input from said first summer;

an auxiliary noise source introducing auxiliary noise to said model reference and to said active model;

a third adaptive filter having a filter input receiving said auxiliary noise;

a third summer summing the output of said third adaptive filter and the output of said error transducer and supplying the resultant sum as an error input to said third adaptive filter, wherein said second adaptive filter comprises first and second algorithm filters each having an error input from the output of said first summer, and comprising:

a fourth summer summing the outputs of said first and second algorithm filters and supplying the resultant sum as an input to said second summer;

a first copy of said third adaptive filter having an input from said error transducer;

a second copy of said third adaptive filter having an input from the output of said fourth summer;

a first multiplier multiplying the output of said first copy with the output of said first summer and supplying the resultant product as a weight update signal to said first algorithm filter;

a second multiplier multiplying the output of said second copy with said output of said first summer and supplying the resultant product as a weight update signal to said second algorithm filter.

29. The invention according to claim 28 comprising:

a third copy of said third adaptive filter having an input from the input to said first adaptive filter;

a third multiplier multiplying the output of said third copy with the output of said first summer and supplying the resultant product as a weight update signal to said first adaptive filter.

30. The invention according to claim 29 comprising:

a fourth copy of said third adaptive filter having an input from the output of said first adaptive filter;

a fifth summer summing the output of said fourth copy and the output of said first summer and supplying the resultant sum as an input to said first adaptive filter.

31. The invention according to claim 28 wherein said first adaptive filter comprises third and fourth algorithm filters, and comprising:

a fifth summer summing the outputs of said third and fourth algorithm filters;

a sixth summer summing said auxiliary noise and the output of said fifth summer and supplying the resultant sum to said second summer;

a third copy of said third adaptive filter having an input from the input to said third algorithm filter;

a fourth copy of said third adaptive filter having an input from the output of said fifth summer;

a third multiplier multiplying the output of said third copy with the output of said first summer and supplying the resultant product as a weight update signal to said third algorithm filter;

a fourth multiplier multiplying the output of said fourth copy with the Output of said first summer and supplying the resultant product as a weight update signal to said fourth algorithm filter.

32. The invention according to claim 31 comprising a fourth adaptive filter modeling the quotient of said model reference and said active model, and having a filter input from the output of said sixth summer, a filter output to said second summer, and an error input from the output of said first summer.

33. The invention according to claim 32 comprising:

a fifth copy of said third adaptive filter having an input from the output of said sixth summer;

a fifth multiplier multiplying the output of said fifth copy with the output of said first summer and supplying the resultant product as a weight update signal to said fourth adaptive filter.

34. An active acoustic attenuation system comprising:

an output transducer introducing a canceling acoustic wave to attenuate an input acoustic wave and yield an attenuated output acoustic wave;

an error transducer sensing said output acoustic wave;

a first adaptive filter outputting a correction signal to said output transducer to introduce the canceling acoustic wave;

a model reference having a selectably programmable response;

an active model comprising in combination the acoustic path between said output transducer and said error transducer and a second adaptive filter such that the combination of said acoustic path and said second adaptive filter adaptively models said model reference such that the combined response of said acoustic path and said second adaptive filter provides an active model response matching the response of said model reference;

a first summer summing the outputs of said model reference and said active model and providing the resultant sum as an error signal;

an auxiliary noise source providing auxiliary noise; a second summer summing said auxiliary noise and the output of said first adaptive filter;

a third adaptive filter modeling the quotient of said model reference and said active model, and having a filter input from the output of said second summer;

a third summer summing the outputs of said second and third adaptive filters and providing the resultant sum to said output transducer.

35. The invention according to claim 34 comprising:

a fourth adaptive filter having a filter input from the output of said third adaptive filter;

a fourth summer summing the output of said fourth adaptive filter and the output of said error transducer and supplying the resultant sum as an error input to said fourth adaptive filter;

a copy of said fourth adaptive filter having a filter input from the output of said second summer;

a multiplier multiplying the output of said copy with the output of said first summer and supplying the resultant product as a weight update signal to said third adaptive filter.

36. An active acoustic control method comprising providing a model reference having a selectably programmable response, providing an active model comprising in combination an acoustic path and an adaptive filter coupled in antiparallel feedback relation wherein the input of said adaptive filter receives the output of said acoustic path, and the output of said adaptive filter is supplied to the input of said acoustic path, such that the output of said acoustic path is fed back through said adaptive filter to the input of said acoustic path, and actively modeling said model reference with the combination of an acoustic path and an adaptive filter such that the combined response of said acoustic path and said adaptive filter provides an active model response matching the response of said model reference.

37. The method according to claim 36 comprising:

introducing an acoustic wave to said acoustic path with a first transducer;

sensing the response of said acoustic path with a second transducer;

summing the outputs of said model reference and said active model with a summer and providing the resultant sum as an error signal;

providing said adaptive filter with a filter input from said second transducer, a filter output to said first transducer, and an error input from said summer.

38. The method according to claim 37 wherein said acoustic path is subject to external disturbances, and comprising introducing auxiliary noise to said active model from an auxiliary noise source, said auxiliary noise being random and uncorrelated to said external disturbances, summing the output of said adaptive filter and said auxiliary noise and providing the resultant sum to said first transducer, providing the output of said active model to the input of said adaptive filter and to said first mentioned summer.

39. An active acoustic control method comprising providing a model reference having a selectably programmable response, and actively modeling said model reference with the combination of an acoustic path and an adaptive filter such that the combined response of said acoustic path and said adaptive filter provides an active model response matching the response of said model reference;

introducing an acoustic wave to said acoustic path with a first transducer;

sensing the response of said acoustic path with a second transducer;

summing the outputs of said model reference and said active model with a summer and providing the resultant sum as an error signal;

providing said adaptive filter With a filter input from said second transducer, a filter output to said first transducer, and an error input from said summer;

modeling the quotient of said model reference and said active model with a second filter, to improve matching of said model reference and said active model.

40. An active acoustic control method comprising providing a model reference having a selectably programmable response, and actively modeling said model reference with the combination of an acoustic path and an adaptive filter such that the combined response of said acoustic path and said adaptive filter provides an active model response matching the response of said model reference;

introducing an acoustic wave to said acoustic path with a first transducer;

sensing the response of said acoustic path with a second transducer;

summing the outputs of said model reference and said active model with a summer and providing the resultant sum as an error signal;

providing said adaptive filter with a filter input from said second transducer, a filter output to said first transducer, and an error input from said summer;

modeling the quotient of said active model and said model reference with a second filter, to improve matching of said active model and said model reference.

41. The method according to claim 37 comprising additionally attenuating an input acoustic wave, comprising introducing a canceling acoustic wave from said first transducer to attenuate said input acoustic wave and yield an attenuated output acoustic wave, sensing said output acoustic wave with said second transducer, outputting a correction signal from a second adaptive filter to said first transducer to introduce the canceling acoustic wave.

42. The method according to claim 41 comprising summing the outputs of said first and second adaptive filters and supplying the resultant sum to said first transducer, providing said output of said first summer as an error input to each of said first and second adaptive filters.

* * * * *